United States Patent [19]

Oliphant

[11] 4,428,443

[45] Jan. 31, 1984

[54] SHOCK ABSORBING TOOL FOR CONNECTION TO A DRILL COLUMN

[75] Inventor: Stephen E. Oliphant, Arvada, Colo.

[73] Assignee: Stability Drilling Systems, Inc., Denver, Colo.

[21] Appl. No.: 304,112

[22] Filed: Sep. 21, 1981

[51] Int. Cl.[3] ..... E21B 17/07

[52] U.S. Cl. ..... 175/321; 175/56; 267/137; 464/20

[58] Field of Search ..... 175/321, 320, 322, 56, 175/55; 464/20, 19, 183, 180; 267/125, 137, 141, 141.6; 293/133

[56] References Cited

U.S. PATENT DOCUMENTS

| | | | |
|---|---|---|---|
| 2,953,351 | 9/1960 | Bodine et al. | 255/4.4 |
| 3,257,827 | 6/1966 | Hughes | 64/27 |
| 3,267,695 | 8/1966 | Toelke | 64/1 |
| 3,274,798 | 9/1966 | Wiggins, Jr. | 64/1 |
| 3,411,321 | 11/1968 | Schurman | 64/1 |
| 3,447,340 | 6/1969 | Garrett | 175/321 |
| 3,610,347 | 10/1971 | Diamantides | 175/55 |
| 3,612,223 | 10/1971 | Shiomi | 293/133 |
| 4,190,276 | 2/1980 | Hirano et al. | 293/133 |
| 4,272,114 | 6/1981 | Hirano et al. | 293/133 |

*Primary Examiner*—Ernest R. Purser

*Assistant Examiner*—Hoang C. Dang

[57] ABSTRACT

A shock absorbing tool is provided for connection to a drill column. The drill column includes a drill bit and is positioned in a bore formed in the earth. The shock absorbing tool is an integral, resilient cylindrical member having a number of open sections formed in the cylindrical member. Pairs of open sections are interconnected by slots. Pairs of open sections are longitudinally spaced along the periphery of the cylindrical member. The longitudinal distance between pairs of open sections and the circumferential distance between open sections of each pair of open sections vary. Upon application of dynamic axial and torsional loads to the drill column, the shock absorbing tool absorbs these loads through deflection of the resilient tool such that the slots close and the stress produced by the dynamic loading is carried about the periphery of the open sections. The aforesaid arrangement of open sections and slots permits absorption of varying magnitudes of forces along different portions of the tool to dampen harmonic hysteresis occurring in the tool as a result of the dynamically applied loads. In the preferred embodiment, each of the slots completely closes upon application of different predetermined force applied to the tool in order to provide a variable shock absorbing device.

6 Claims, 6 Drawing Figures

SHOCK ABSORBING TOOL FOR CONNECTION TO A DRILL COLUMN

FIELD OF THE INVENTION

The present invention relates to a shock absorbing element provided in a drill column and, in particular, to an integral, resilient, shock absorbing tool for absorbing shocks and vibrations generated during a drilling operation.

BACKGROUND ART

During the drilling of bores or wells in the earth using a drill column having a drill bit, forces are produced in a longitudinal direction with respect to the drill column. Forces are also generated tending to rotate the drill bit together with the remaining portions of the drill column. The longitudinal or axial and rotational or torsional forces are absorbed by shock absorbing elements connected within the drillstring. Various shock absorbing elements have been devised. In one known tool, the shock absorbing element comprises a gas-spring system including telescoping body sections having a floating piston within. On one side of the piston is nitrogen gas while oil is housed on the other side. Another known shock absorber apparently utilizes an arrangement of springs to permit use in various down hole temperatures and pressures.

The present invention employs a single shock absorbing element having a configuration which permits deflections of portions of the tool for absorbing forces applied thereto and which resiliently, like a spring, resumes its original, non-deflected form upon removal of the forces. The present invention is characterized by minimal parts and a unique arrangement of openings formed throughout the periphery of the tool to allow for ready absorption of the applied axial and torsional forces.

PRIOR ART STATEMENT

U.S. Pat. No. 3,257,827 to Hughes describes a drillstring shock absorber including two sets of clutch teeth vertically disposed from each other using resilient transfer elements positioned therebetween.

U.S. Pat. No. 2,953,351 to Bodine et al. discloses a vibration absorber characterized by its discontinuous coupling to a drill bit. In one embodiment, the absorber includes four spiral slots comprised of four closely spaced spiral bars. The spiral bars are hollow for carrying mud fluid.

U.S. Pat. No. 3,610,347 to Diamantides provides a vibratory drill apparatus having a sleeve or connecting member for joining together a vibrator and a head. In one example, the sleeve includes non-interconnected multiple slots formed therein.

U.S. Pat. No. 3,274,798 to Wiggins, Jr. describes a vibrator-related tool having an inner wall made of a material with a predetermined Young's modulus. In one embodiment, bellows-shaped tubular convolutions are connected outwardly of the inner wall to prevent excessive buckling.

U.S. Pat. No. 3,411,321 to Schurman illustrates a fluid bypass drill collar having ports to permit mud flow between a drillstring and a bore.

U.S. Pat. No. 3,267,695 to Toelke provides a drillstring including longitudinally and circumferentially extending recesses for use in preventing the sticking of the drillstring in a well bore.

U.S. Pat. No. 4,272,114 to Hirano et al. discloses an impact absorbing device which includes a hollow polyhedral body formed with a plurality of elongated cutouts. The cut-outs extend spatially along the longitudinal axis of the device. The device is intended to be connected to a vehicle for absorbing an impact force exteriorly applied to the vehicle. The device deforms or partially breaks when subjected to the impact energy.

DISCLOSURE OF THE INVENTION

In accordance with the present invention, a shock absorbing tool is provided for connection to a drill bit for use with a drillstring which is inserted into a bore formed in the earth. The shock absorbing tool is a tubular member integrally joined to a main mandrel of the drillstring. The shock absorbing tool includes open sections or pockets formed throughout the circumferential periphery thereof. Pairs of open sections are interconnected by slots or anvils. The slots are substantially smaller in size or dimension than the open sections at the tool periphery. During operation of the tool, the tool deflects in a longitudinal direction in response to compressive forces applied thereto. The interconnecting slots begin to close to dampen the compressive loading. Upon a predetermined compressive force being applied to the shock absorbing tool, one or more of the slots completely close and the load is distributed about the tool adjacent the periphery of those open sections interconnected by the closed slots. In addition to absorbing the axial compressive forces, the open sections/slots arrangement provides for absorption of torsional forces. The shock absorbing tool is also operated below its elastic region. That is to say, the predetermined compressive forces for closing the slots are less than the force which would cause unwanted damage to the shock absorbing tool.

More particularly, each of the open sections is generally oval-shaped with the lateral extent thereof greater than the longitudinal extent thereof in order to facilitate dampening of the axial compressive forces which the drillstring is subjected to during the drilling operation. The interconnecting slots extend between end portions of laterally adjacent open sections to provide a continuous opening of different longitudinal dimensions at the periphery of the tool. Preferably, the longitudinal distance between adjacent open sections varies along the length of the tool. The circumferential distance between adjacent open sections also changes. As a result, dynamic compressive forces are absorbed at different areas along the shock absorbing element.

Based on the foregoing disclosure, it is readily appreciated that a relatively simply constructed shock absorbing element is provided to reduce shocks and vibrations generated axially and torsionally in a drill column. The resilient, tubular shock absorbing tool of the present invention is directly connected to the main mandrel of the drill column to enhance the strength of the drill column. The shock absorbing element is devised so that the compressive forces applied thereto are distributed about the open sections while the slots close. The open sections and slots are located about the tool to permit absorption of shocks and vibrations along different regions of the tool, depending upon the magnitude of the forces applied. As a result, this configuration dampens harmonic hysteresis which may be present in the spring-like tool of the present invention. In addition, numerous, moving, shock absorbing elements are not needed. As a consequence, cost of the shock absorbing tool is minimized and maintenance of the shock absorbing tool is reduced. Furthermore, the shock absorbing tool can be readily replaced if required and is easily transported to on-sight operations.

Additional advantages of the present invention will become readily apparent from the following discussion taken in conjunction with the accompanying drawings.

DESCRIPTION OF THE PREFERRED EMBODIMENT

Figure 1:
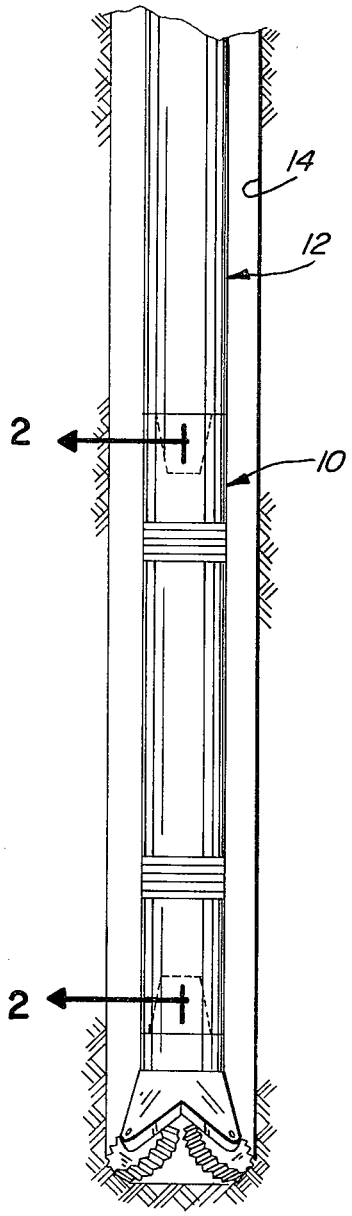
FIG. 1 is a longitudinal sectional view of a lower portion of a bore showing the present invention connected to a drill column.

In accordance with the present invention, a shock absorbing tool 10 is provided for connection to a drill column or drillstring 12. The drill column 12 is conventionally formed for insertion into a bore 14 formed in the earth, as illustrated in FIG. 1. The drill column 12 extends from the bottom of the bore 14 to the surface of the earth and is driven in a rotating manner using an appropriate power source.

The drill column 12 includes a drill bit for loosening or digging the earth at the bottom of the bore 14 as the drill column 12 is driven. The drill bit may include any one of a number of known and acceptable configurations and its particular structure is not significant to the operation of the present invention as herein described. In one application, the shock absorbing tool 10, drill column 12 and drill bit are used in oil exploration in which the drill bit is positioned thousands of feet into the earth.

Figure 2:
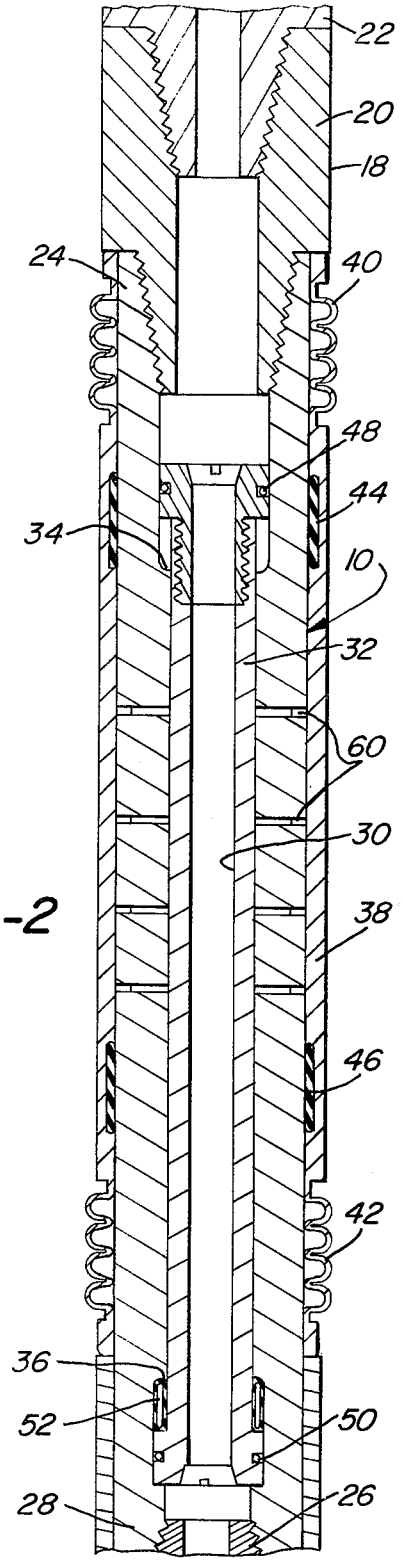
FIG. 2 is an enlarged, longitudinal sectional view, taken along line 2—2 of FIG. 1, showing the shock absorbing tool of the present invention connected to the main mandrel of the drill column.

As depicted in FIG. 2, the drill column 12 includes a main mandrel 18 having an upper portion 20 which is threaded at both ends. At a first threaded end, the upper portion 20 is fastened to a top adaptor sub 22 of drill column 12. At its second threaded end, the upper portion 20 tapers for fastening to the threaded upper end 24 of the shock absorbing tool 10. The lower portion 26 of the main mandrel 18 is also threaded for connection to the lower end 28 of the shock absorbing tool 10.

A central opening 30 is formed through the shock absorbing tool 10 and is aligned with bores or openings formed in the remaining portions of the drill column 12 for carrying mud fluid as is typical in a drilling operation. A safety tube 32 is positioned in the central opening 30 of the shock absorbing tool 10 and extends for a distance substantially equal to the length of the shock absorbing tool 10. The safety tube 32 is provided to permit easy removal of the shock absorbing tool 10 if an unlikely catastrophic failure thereof should occur. In the unlikely event that the shock absorbing tool 10 breaks up into two or more separate portions, safety tube 32 provides a common connection between the severed or broken portions so that all portions of the shock absorbing tool 10 can be completely removed. Specifically, upper shoulder 34 and lower shoulder 36 of the shock absorbing tool 10 are provided to engage upper and lower portions of the safety tube 32 and to be confined by the safety tube 32 if portions of the shock absorbing tool should separate and move longitudinally.

A housing sleeve 38 surrounds the shock absorbing tool 10 and is joined to the main mandrel 18 by means of a threaded connection, for example. The housing sleeve 38 acts as a contaminant shield to prevent access to the shock absorbing tool by mud fluid or other debris located in the bore 14. The housing sleeve 34 includes bellows members 40, 42 which are provided to accommodate for movement of the housing sleeve 38 relative to the shock absorbing tool 10 during the drilling operation.

In addition to the housing sleeve 38, upper and lower seal members 44, 46, upper and lower ring seals 48, 50 and inner seal 52 are provided to minimize the amount of mud fluid or other debris entering and contacting the shock absorbing tool 10. The upper and lower seal members 44, 46 are located between the housing sleeve 38 and the outer circumferential surface of the shock absorbing tool 10 adjacent top and bottom portions thereof. The upper and lower ring seals 48, 50 and inner seal 52 are provided between the shock absorbing tool 10 and the safety tube 32.

The shock absorbing tool 10 is included in the drill column 12 because of the significant harmonic motion generated in the drill column 12 during the drilling operation. The harmonic motion in the drill column 12 occurs as a result of the cyclic stress caused by the rotational motion applied thereto, the length of the drill column 12 itself, and the axial forces or load applied thereto during the drilling operation in which the drill bit 16 engages the extremely hard surface of the earth. The harmonics developed create unwanted loads in the drill column 12 in both a longitudinal or axial direction and in a torsional or rotational direction. Such loads approach magnitudes of 150,000 pounds, 6,000 ft.-lbs. and vertical oscillations of $\pm\frac{1}{2}$ inch. The shock absorbing tool 10 is provided then to reduce damage to the drill bit 16 as well as maximize the useful life of the drill bit 16 and thereby minimize the costs inherent in the drilling operation.

Figure 3:
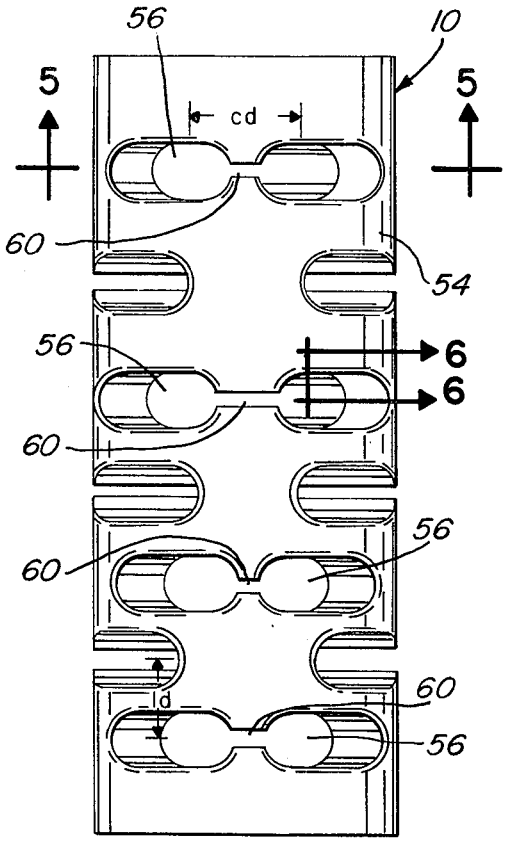
FIG. 3 is a side elevational view of the shock absorbing tool showing the arrangement of open sections and slots at the periphery of the tool.
Figure 5:
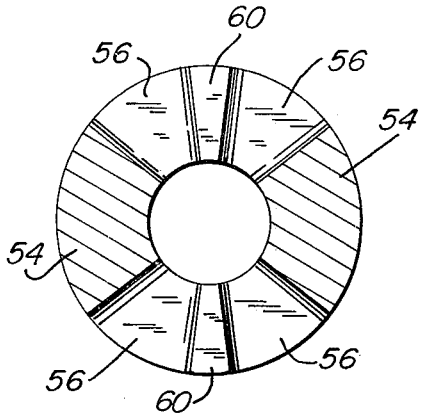
FIG. 5 is a lateral section, taken along line 5—5 of FIG. 3, showing an arrangement of open sections and slots about the circumference of the shock absorbing tool.
Figure 6:
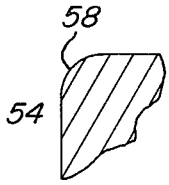
FIG. 6 is a fragmentary, longitudinal section, taken along lines 6—6 of FIG. 3, illustrating the curved configuration of the open sections.

The shock absorbing tool 10 of the present invention is best illustrated in FIG. 3. The shock absorbing tool is a tubular, cylindrical, resilient member 54. The cylindrical, resilient member 54 includes a plurality of generally, oval-shaped open sections or pockets 56 formed or milled about the periphery of the resilient member 54. As seen in FIG. 5, the open sections 56 extend through to the central opening 30 of the shock absorbing tool 10. As illustrated in FIG. 6, each of the open sections 56 are formed having a curved inner surface 58. Pairs of open sections 56 are interconnected by means of slots or anvils 60. Each slot 60 is an aperture which is relatively narrow in its extension in a direction along the longitudinal axis of the shock absorbing tool 10 and is substantially less in extension in a longitudinal direction at the circumferential periphery of the shock absorbing tool 10 than is the longitudinal extension of each open section 56. This configuration of open sections 56 and slots 60 provides a spring-like resiliency to the cylindrical member 54 in order to permit deflection thereof through the closing of the slots 54 and the absorbing of a load along the curved inner surface 58 of the open sections 56, as will be described more fully later.

In the preferred embodiment and as depicted in FIG. 3, the longitudinal distance between adjacent pairs of open sections 56 varies along the longitudinal extent of the cylindrical member 54. Specifically, the longitudinal distance (1*d*) between pairs of open sections 56 near the lowe end 28 of the cylindrical member 54, which is relatively more adjacent the drill bit 16, is less than the longitudinal distance between pairs of open sections 56 located relatively more adjacent the upper end 24 of the cylindrical member 54.

In addition, in the preferred embodiment, the circumferential distance (cd) between the two open sections 56 of a pair of open sections 56 also changes along the longitudinal extent of the shock absorbing tool. Specifically, the circumferential distance decreases in a direction from the lower end 28 (adjacent drill bit 16) of the cylindrical member 54 to the upper end 24 thereof.

Figure 4:
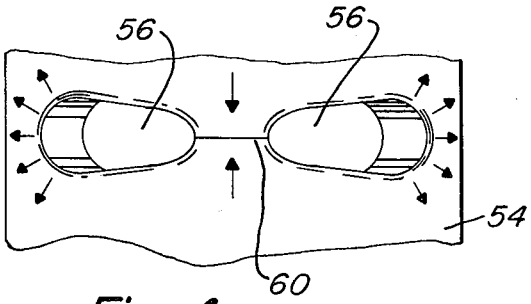
FIG. 4 is an enlarged, fragmentary, longitudinal section of the shock absorbing tool illustrating the closing of one of the slots upon application of a predetermined compressive force.

The above described preferred arrangement of open sections 56 and slots 60 acts, during the drilling operation, to provide a variable shock and vibration absorption capability. The pairs of open sections 56 and their interconnecting slots 60 relatively more adjacent the drill bit 16 will absorb the primary and lower impact loads to which the shock absorbing tool 10 and drill column 12 are first subjected. To absorb these initial compressive forces which are developed, the slot or slots 60 most adjacent the drill bit 16 starts to close. After a predetermined compressive force is applied to the shock absorbing tool 10, this slot 60 completely closes while substantial portions of the two open sections 56, which this slot 60 interconnects, remain open and the applied stress is taken up at the peripheral edges and curved inner surfaces 58 of the open sections 56, as illustrated by the arrows of FIG. 4.

In like manner, increasingly applied loads are absorbed by longitudinally adjacent open sections 56 and slots 60. As a consequence, a wide range of loads is absorbed through the variable absorption capability of the shock absorbing tool 10 and this variable absorption feature serves to dampen the harmonic hysteresis which is normally present in linear spring-like elements.

In addition to absorbing the axial compressive forces which are developed in the drilling operation, the shock absorbing tool 10 also absorbs torsional loads or rotational forces which are generated during the drilling operation by permitting sliding or slipping movement between edges of each slot 60 as the edges come in contact due to the compressive forces.

As noted hereinabove, the slot 60 most adjacent the drill bit 16 closes upon application of a predetermined compressive force applied to the shock absorbing tool 10. Similarly, in the preferred embodiment, each slot 60 closes upon application of a predetermined compressive force applied to the shock absorbing tool 10, with each predetermined compressive force being different in magnitude for each slot 60.

Each predetermined compressive force is selected so that the shock absorbing tool 10 is not overloaded such that the shock absorbing tool 10 is operated below its elastic limit. As a result, upon removal of the applied shocks and vibrations, the resilient shock absorbing tool 10 returns to its initial state in which the slots 60 are once again open and the open sections 56 resume their initial configuration.

The shock absorbing tool is preferably made of a fatigue-resisting 4000 carbon series steel which has been heat treated and which operates within 80% of its elastic limit. This material is chosen for its strength and its ability to withstand cyclic loading.

The length of the cylindrical shock absorbing tool 10 lies in the range of about 3.5–5.5 feet. The thickness of the wall of the shock absorbing tool (distance between outer and inner diameters of the tubular tool) is between about 1–1.5 inches. The 5.5 foot shock absorbing tool 10 has an outer diameter of approximately 9 inches and can absorb dynamic loads in the range of 120,000–130,000 lbs./in. The 3.5 foot shock absorbing tool has an outer diameter of approximately 6 inches and can absorb dynamic loads in the range of 40,000–50,000 lbs./in.

The width or extent of the slots 60 in a longitudinal direction at the circumferential periphery of the shock absorbing tool 10 has a range of about 0.03–0.05 of an inch. The circumferential distance between two open sections 56 of a pair of open sections 56 has a range of about 0.5–4 inches.

The average width or extent of each open section 56 in a longitudinal direction is about 0.75 of an inch. The lateral extent of the open sections has a range of about 1.5–2 inches.

Based on the foregoing description, a number of advantages of the present invention are readily seen. A tubular cylindrical, resilient, shock absorbing tool for use in the drilling industry is provided for absorbing both axially and torsionally applied forces of significant magnitude. The shock absorbing tool includes a preferred arrangement of open sections and slots to provide a variable absorption capability to dampen harmonic hysteresis which is commonly found in linear spring-like elements. The shock absorbing tool of the present invention is a single, integral element to permit ready attachment to and removal from a drill column as well as reducing maintenance because of the minimum number of parts present in the shock absorbing tool. The shock absorbing tool is operated below its elastic region to absorb shocks and vibrations using its resilient properties.

Although the present invention has been described with reference to a particular embodiment thereof, it is appreciated that variations and modifications can be effected within the spirit and scope of this invention.

What is claimed is:

1. A shock absorbing tool adapted for use in a drillstring including a drill bit, comprising:

a cylindrical, resilient member having an outer surface and a plurality of open sections formed therein, said open sections being spaced from each other about the periphery of said cylindrical member, said cylindrical member having a first slot formed therein and interconnecting a first pair of open sections, the width of said first slot at said outer surface of said member in the absence of a compressive force applied to said member being at least about 0.03 of an inch, said resiliency of said member being of a kind wherein said first slot closes upon application of a predetermined compressive force applied to the tool while portions of said first pair of open sections remain open upon application of the predetermined compressive force, said resiliency of said cylindrical member being of a kind wherein said first slot resumes its initial open state upon removal of the predetermined compressive force, said cylindrical, resilient member being formed of a material and being of a configuration wherein said member substantially operates below its elastic limit, said member acting to reduce both torsional and axial dynamic loading through the closing of said first slot.

2. The tool, as claimed in claim 1, wherein:

pairs of said open sections are spatially disposed along said cylindrical member in a longitudinal direction and the longitudinal distance between said pairs of said open sections varies to minimize harmonic hysteresis of the tool due to dynamically applied loads.

3. The tool, as claimed in claim 2, wherein:

the longitudinal distance between said open sections increases with increasing distance of portions of the shock absorbing tool from the drill bit to minimize harmonic hysteresis of the tool due to dynamically applied loads.

4. The tool, as claimed in claim 1, further including:

a second slot interconnecting a second pair of said open sections, said second slot closing upon application of a second predetermined compressive force applied to the tool in order to dampen harmonic hysteresis occurring as a result of the application of increasing loads to the tool.

5. A tool, as claimed in claim 4, wherein:

the circumferential distance between said open sections of said first pair of said open sections is different than the circumferential distance between said open section of said second pair of said open sections so that dynamic loads applied to the tool are absorbed along different portions thereof to dampen the harmonic hysteresis occurring as a result of the application of increasing loads to the tool.

6. A tool, as claimed in claim 5, wherein:

the circumferential distance between said open sections of said first pair of open section is greater than the circumferential distance between said open sections of said second pair of open sections, said first pair of said open sections being more adjacent the drill bit than said second pair of open sections, to dampen the harmonic hysteresis.

* * * * *